US009834020B2

(12) United States Patent
Matsumine

(10) Patent No.: US 9,834,020 B2
(45) Date of Patent: Dec. 5, 2017

(54) PRINTING SYSTEM

(71) Applicant: RISO KAGAKU CORPORATION, Tokyo (JP)

(72) Inventor: Yukimori Matsumine, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/351,899

(22) Filed: Nov. 15, 2016

(65) Prior Publication Data

US 2017/0151820 A1 Jun. 1, 2017

(30) Foreign Application Priority Data

Nov. 27, 2015 (JP) ..... 2015-231207

(51) Int. Cl.
*B41J 29/38* (2006.01)
*B41J 11/00* (2006.01)

(52) U.S. Cl.
CPC ..... *B41J 29/38* (2013.01); *B41J 11/0015* (2013.01)

(58) Field of Classification Search
USPC ..... 399/239, 408; 270/58.08, 58.09
See application file for complete search history.

(56) References Cited

U.S. PATENT DOCUMENTS 6,213,456 B1 * 4/2001 Hirano ..... G03G 15/6541 270/58.07
7,151,908 B2 * 12/2006 Iwai ..... G03G 15/6541 399/407
7,346,309 B2 * 3/2008 Nakamura ..... G03G 15/6544 399/408
2006/0029445 A1 * 2/2006 Nakamura ..... G03G 15/6544 399/329

FOREIGN PATENT DOCUMENTS

JP 2007-163559 6/2007

* cited by examiner

*Primary Examiner* — Lam Nguyen
(74) *Attorney, Agent, or Firm* — Greenblum & Bernstein, P.L.C.

(57) ABSTRACT

When it is determined by the post-process determination unit that a received top job requires a bookbinding process (post-process) and that a received subsequent job does not require a bookbinding process (post-process), the sheet setting determination unit determines whether or not there is a match between the sheet size (sheet setting) of the top job and the sheet size (sheet setting) of the subsequent job, and when it is determined by the sheet setting determination unit that there is a match between the sheet size (sheet setting) of the top job and the sheet size (sheet setting) of the subsequent job, the execution management unit causes the printing machine to perform the printing process on the basis of the subsequent job during the warm-up of the bookbinding device.

4 Claims, 5 Drawing Sheets

PRINTING SYSTEM

BACKGROUND

1. Technical Field

The present invention relates to a printing system that performs a printing process and a post-process after completion of warm-up of a post-processing device, on the basis of a job which includes a post-process, while effectively utilizing a warm-up time.

2. Related Art

A printing system includes a printing machine that prints an image on a sheet on the basis of a job, and a post-processing device that performs a post-process on a sheet printed by the printing machine.

The printing machine, for example, has detachably provided thereto an ink cartridge storing ink for each color and, with ink being supplied to an ink-jet head from the ink cartridge, ejects ink toward the sheet from a nozzle of the ink-jet head to print an image or a character thereon.

In addition, the post-processing device is provided with various types of post-processing functions, according to the applications. A post-processing function is, for example, a function of performing an enclosing-and-sealing process in which a printed sheet is folded, and enclosed and sealed in an envelope as a content, and a bookbinding process in which the spine of a book is glued to bind the book. Although the post-processing device has a function of performing one or more of post-processes among the post-processes, warm-up of the post-processing device is required for raising the glue temperature or the like, when performing the enclosing-and-sealing process or the bookbinding process.

Japanese Patent Application Publication No. 2007-163559 proposes a technique relating to an image forming device that calculates the processing time of a job which does not include a post-process requiring warm-up to be performed, among a plurality of preliminarily set jobs, calculates a warm-up completion time of a post-processing device, and, before completion of the warm-up of the post-processing device, determines the order of performing a plurality of jobs which has been set by an input operation unit to perform the jobs, on the basis of the processing time of the job and the warm-up completion time of the post-processing device.

However, since the technique of the aforementioned patent literature performs the job which does not include a post-process to be performed before completion of the warm-up of the post-processing device, there has been a case where a job which includes a post-process to be performed after completion of the warm-up of the post-processing device cannot be performed.

When, for example, a job is performed which does not include a post-process to be performed before completion of the warm-up of the post-processing device, if sheet settings (size, thickness and quality of sheet) are different among respective jobs, there is a case where no paper feed tray exists which places sheets corresponding to the sheet setting of the job that does not include a post-process to be performed. In such a case, a user is supposed to remove one of the currently provided paper feed trays and replace it with a paper feed tray having placed thereon sheets corresponding to the sheet setting of the job that does not include a post-process to be performed. On this occasion, assuming that sheets corresponding to the job which includes a post-process to be performed are placed on the removed paper feed tray, there arises a problem that print sheets may be recognized as "running out of sheets" after having performed the job which does not include a post-process to be performed and therefore it is impossible to perform a job which includes a post-process to be performed after completion of the warm-up of the post-processing device.

SUMMARY

The present invention has been made in view of the above problem. An object of the present invention is to provide a printing system that can perform a printing process and a post-process after completion of warm-up of a post-processing device, on the basis of a job which includes a post-process, while effectively utilizing a warm-up time.

Means To Solve The Problem

In order to achieve the aforementioned object, a first characteristic of a printing system according to the present invention is a printing system including a printing machine that picks up sheets placed on a paper feed tray and performs a printing process thereon, and a post-processing device that performs a post-process on the sheets printed by the printing machine, the system including: a post-process determination unit configured to determine whether or not a post-process requiring warm-up is included in a received job; a sheet setting determination unit configured to determine, when the post-process determination unit has determined that a received top job includes a post-process requiring the warm-up and that a received subsequent job does not include a post-process requiring the warm-up, whether or not there is a match between a sheet setting of the top job and a sheet setting of the subsequent job; and an execution management unit configured to cause the printing machine to perform a printing process on the basis of the subsequent job during the warm-up of the post-processing device, when the sheet setting determination unit has determined that there is a match between the sheet setting of the top job and the sheet setting of the subsequent job.

A second characteristic of the printing system according to the present invention is that the sheets placed on the paper-feed tray are one type of sheets.

A third characteristic of the printing system according to the present invention lies in further including a notification unit; and a residual quantity detection unit configured to detect a residual quantity of sheets placed on the paper feed tray, and in that the execution management unit causes the notification unit to give an alarm requesting replenishment of sheets before starting the subsequent job, in a case where the number of sheets in the printing machine detected by the residual quantity detection unit is smaller than the number of sheets to be used by the top job and the subsequent job, when causing the printing machine to perform a printing process on the basis of the subsequent job during the warm-up of the post-processing device.

BRIEF DESCRIPTION OF DRAWINGS

The invention will now be described with reference to the accompanying drawings wherein.

DETAILED DESCRIPTION

Embodiments of the present invention will be described below with reference to the drawings.

First Embodiment

Figure 1:
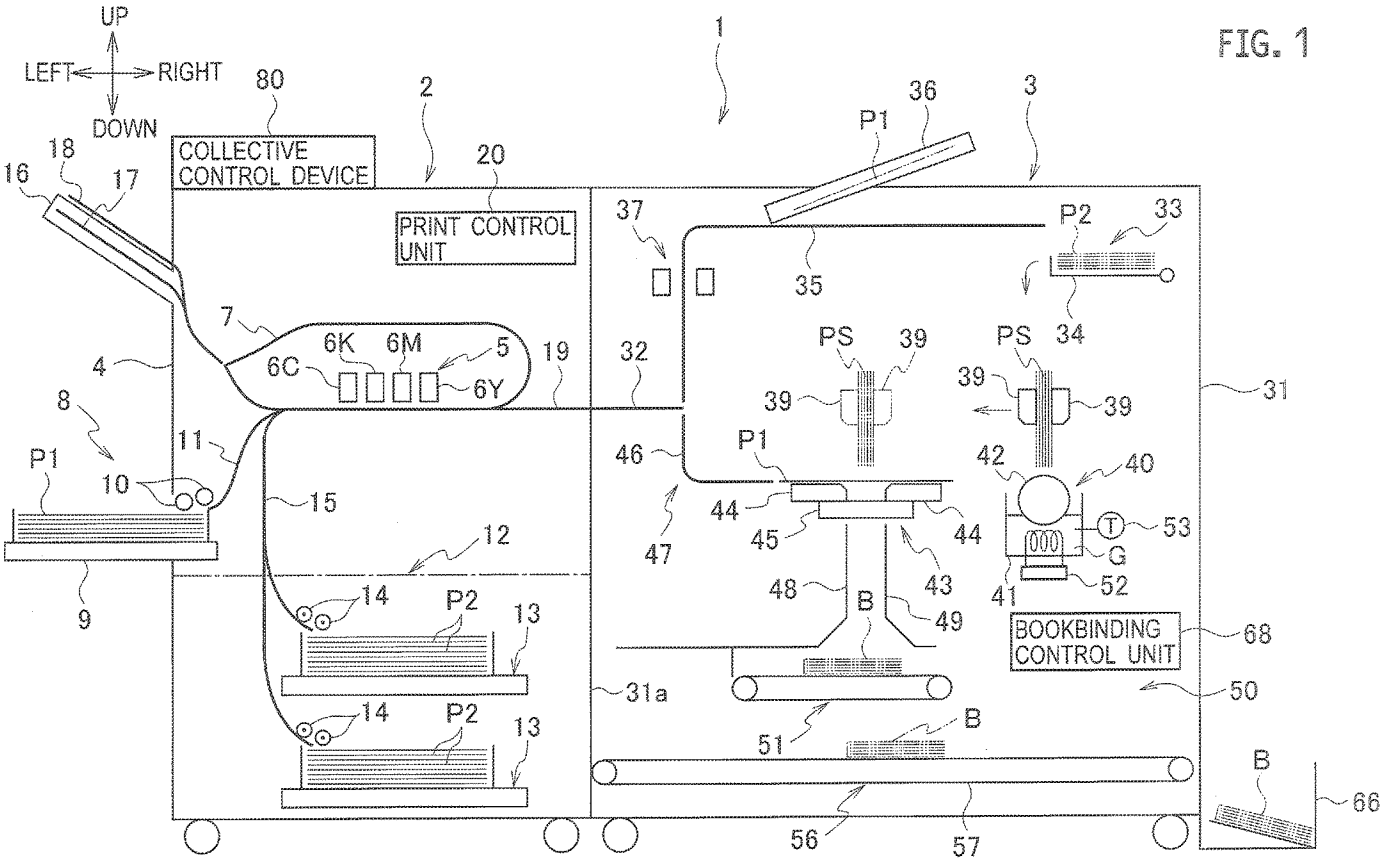
FIG. 1 is an explanatory diagram illustrating an overall configuration of a printing system according to a first embodiment of the present invention.

FIG. 1 is an explanatory diagram illustrating an overall configuration of a printing system 1 configured by using a printing machine 2 together with a bookbinding device 3. In the following description, the sheet front direction of FIG. 2 at which the user is located is assumed to be the front side. In addition, the up, down, right and left seen from the user are assumed to be the up, down, right and left directions.

The printing system 1 according to the present embodiment is a system that makes a booklet from printed sheets. The printing system 1 includes the printing machine 2 and the bookbinding device 3.

The printing machine 2 performs printing on a book cover sheet P1 and a book body sheet P2 included in a booklet made by case-binding in the bookbinding device 3.

The printing machine 2 includes a printing machine housing 4 (referred to as housing 4 as appropriate, in the following). There is provided a printing unit 5 within the housing 4. The printing unit 5 performs printing on the book cover sheet P1 and the book body sheet P2. The printing unit 5 includes line type ink-jet heads 6C, 6K, 6M and 6Y which respectively eject respective ink colors of cyan (C), black (K), magenta (M) and yellow (Y).

In addition, there is provided, within the housing 4, a loop-like printed sheet transfer path 7 for transferring the book cover sheet P1 and the book body sheet P2 in a manner surrounding the printing unit 5. There is provided, at a position along the printed sheet transfer path 7, a plurality of rollers (riot illustrated) for transferring the book cover sheet P1 and the book body sheet P2.

A main paper feed unit 8 is installed at the left side of the housing 4.

The main paper feed unit 8 includes a paper feed tray 9 having sheets stacked thereon, a paper feed roller 10 for sending the sheets stacked on the paper feed tray 9 toward the printing unit 5, and a sensor or the like (not illustrated) that is a residual quantity detection unit capable of detecting the stacked quantity of sheets stacked on the paper feed tray. In addition, the main paper feed unit 8 includes a paper feed transfer path 11 provided between the paper feed tray 9 and the printed sheet transfer path 7, and a plurality of rollers (not illustrated) arranged along the paper feed transfer paths 11 for transferring sheets toward the printing unit 5.

An optional paper feed unit 12 is provided under the printing unit 5 within the housing 4. The optional paper feed unit 12 is an optional accessory, and the printing process can be performed even in a state where the optional paper feed unit 12 is removed.

The optional paper feed unit 12 includes a plurality of paper feed trays 13 for accommodating sheets, and a paper feed roller 14 for sending the sheets accommodated in the respective paper feed trays 13 toward the printing unit 5. In addition, the optional paper feed unit 12 includes the paper feed transfer path 15 provided between the respective paper feed trays 13 and the printed sheet transfer path 7, a plurality of rollers (not illustrated) arranged along the paper feed transfer path 15 for transferring the sheets toward the printing unit 5, and a sensor or the like (not illustrated) that is a residual quantity detection unit capable of detecting the stacked quantity of sheets stacked on the paper feed tray.

Note that, in the printing machine 2 equipped with the optional paper feed unit 12, the main paper feed unit 8 is used as a paper feed unit which feeds the book cover sheet P1 toward the printing unit 5 (toward the printed sheet transfer path 7), and the optional paper feed unit 12 is used as a paper feed unit which feeds the book body sheet P2 toward the printing unit 5 (toward the printed sheet transfer path 7). FIG. 1 illustrates an example in which the printing machine 2 is equipped with the optional paper feed unit 12.

There is provided, on the left upper part of the printed sheet transfer path 7, a switchback unit 16 configured to temporarily accommodate the book cover sheet P1 and the book body sheet P2. In addition, a switchback transfer path 17 is provided from the left part within the housing 4 as far as into the switchback unit 16. The switchback transfer path 17 transfers the book cover sheet P1 and the book body sheet P2 toward the printing unit 5 upside down when performing duplex printing.

There is provided, on the upper surface of the switchback unit 16, a discharge unit 18 for discharging, as necessary, the book cover sheet P1 and the book body sheet P2 after the printing.

There is provided, on the right side part within the housing 4, a communication transfer path 19 for transferring, toward the bookbinding device 3 (toward the right direction), the book cover sheet P1 and the book body sheet P2 which have been sent from the printed sheet transfer path 7.

The printing machine 2 includes a print control unit 20. The print control unit 20 includes a CPU, a RAM, a ROM, and the like. The print control unit 20 controls the operation of each part of the printing machine 2. Details of the print control unit 20 will be described below.

The bookbinding device 3 performs a bookbinding process to make a booklet, on the book cover sheet P1 and the book body sheet P2 which have been printed in the printing machine 2.

Figure 2:
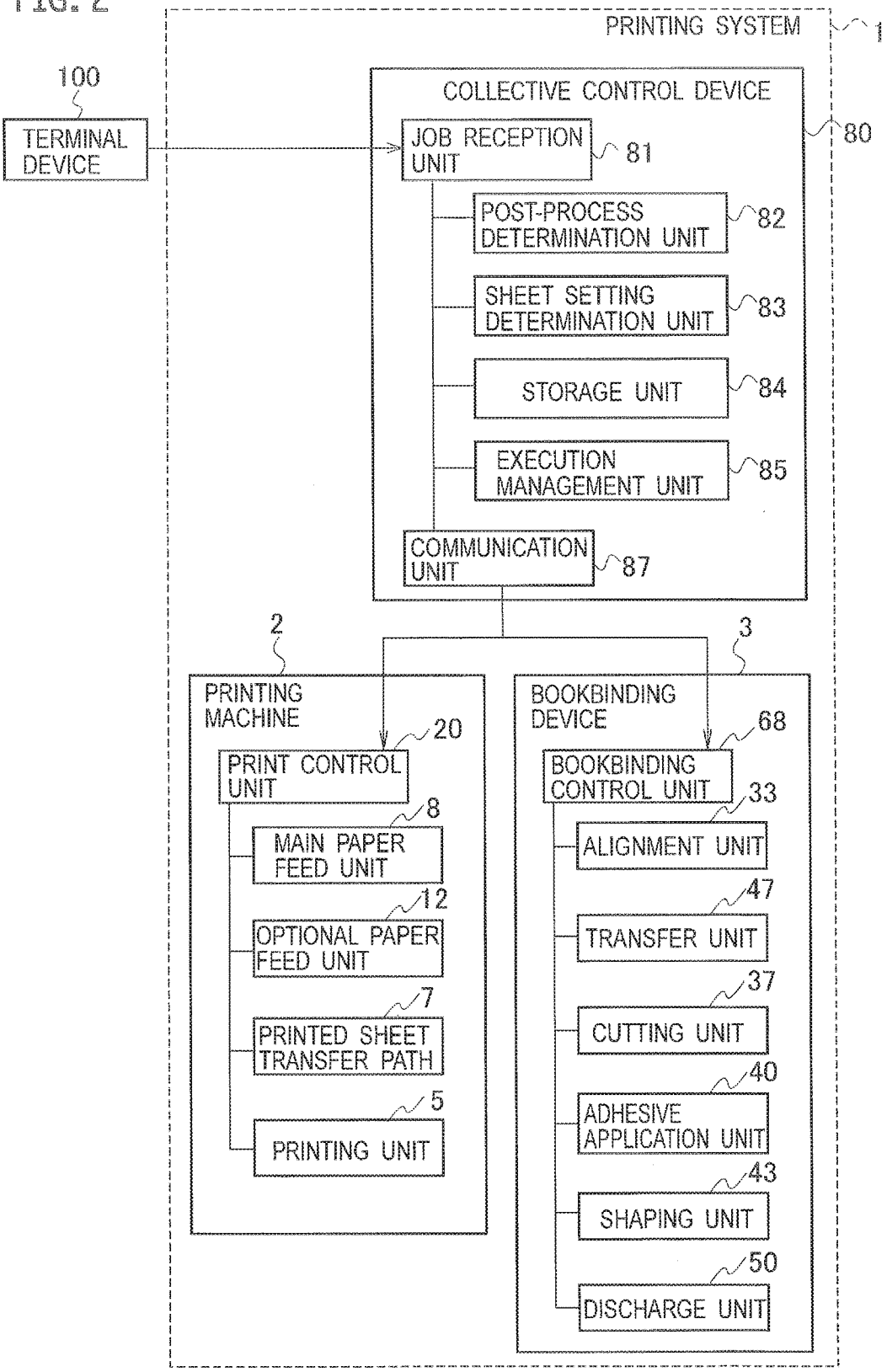
FIG. 2 is an explanatory diagram illustrating a function of the printing system according to the first embodiment of the present invention.

The bookbinding device 3 includes a bookbinding device housing 31 (referred to as housing 31 as appropriate, in the following), as illustrated in FIG. 2. There is provided, within the housing 31, an introduction transfer path 32 for transferring, toward the right direction, the book cover sheet P1 and the book body sheet P2 Which have been printed and sent from the communication transfer path 19 of the printing machine 2. The base end part (left end part) of the introduction transfer path 32 is connected to the front end (right end) of the communication transfer path 19.

There is provided, on the upper right part within the housing 31, an alignment unit 33 configured to align the printed book body sheet P2 to form a sheet stack PS. The alignment unit 33 includes an alignment tray 34 for stacking a plurality of sheets of the book body sheet P2.

In addition, there is provided, on the upper part within the housing 31, an upper bookbinding transfer path 35 for transferring, toward the alignment unit 33, the book cover sheet P1 and the book body sheet P2 which have been printed and sent from the introduction transfer path 32. The base end (left end) of the upper bookbinding transfer path 35 is made connectable to or disconnectable from the front end (right end) of the introduction transfer path 32 by a flipper (not illustrated).

There is provided, on the upper center part of the housing 31, a stock tray 36 for temporarily keeping the printed book cover sheet P1 waiting.

There is provided a cutting unit 37 on the left side of the stock tray 36 within the housing 31. The cutting unit 37 cuts the printed book cover sheet P1 into a dimension according to the thickness of sheet stack PS.

There is provided, within the housing 31, a clamp unit 39 which is movable while clamping (pinching) the sheet stack PS sent from the alignment tray 34 (alignment unit 33).

There is provided, on the lower left side of the alignment tray 34 within the housing 31, an adhesive application unit 40 for applying hot melt adhesive G on the back side (lower surface) of the sheet stack PS. The adhesive application unit 40 includes an adhesive accommodating unit 41 for accommodating the hot melt adhesive G. There is provided, within the adhesive accommodating unit 41, an application roller 42 for applying the hot melt adhesive G to the sheet stack PS, a heater 52 for heating the hot melt adhesive G, and a thermometer 53 for measuring the temperature of the hot melt adhesive G.

There is provided a shaping unit 43 on the left side of the adhesive application unit 40. The shaping unit 43 includes a pair of back folding plates 44 and an abutment plate 45 provided under the pair of back folding plates 44.

The book cover sheet P1 is supposed to be bent by pressing of the sheet stack PS from the right and the left by the pair of back folding plates 44 via the book cover sheet P1, in a state where the back side (lower surface) of the sheet stack PS applied with the hot melt adhesive G abuts on the abutment plate 45 via the book cover sheet P1. A booklet B is shaped thereby.

There is provided, under the upper bookbinding transfer path 35 within the housing 31, a lower bookbinding transfer path 46 for transferring the printed book cover sheet P1 sent from the upper bookbinding transfer path 35 to the shaping unit 43.

A transfer unit 47 includes the introduction transfer path 32, the upper bookbinding transfer path 35, the lower bookbinding transfer path 46, a roller arranged along the paths, a roller for sending the book cover sheet P1 from the stock tray 36 toward the upper bookbinding transfer path 35, and the like.

There is provided, under the shaping unit 43 within the housing 31, guide members 48 and 49 for guiding a completed booklet B dropping from the shaping unit 43. There is provided, under the guide members 48 and 49, a discharge unit 50 for discharging, to the outside of the housing 31, the booklet B which has dropped from the shaping unit 43.

The discharge unit 50 includes an upper conveyer 51 for receiving the booklet B which has dropped from the shaping unit 43, transferring and then dropping the booklet B downward from the left side.

In addition, the discharge unit 50 includes a lower conveyer 56 provided under the upper conveyer 51. The lower conveyer 56 receives the booklet B which has dropped from the upper conveyer 51, transfers the booklet B and discharges it to the discharge tray 66.

The bookbinding device 3 includes a bookbinding control unit 68. The bookbinding control unit 68 includes a CPU, a RAM, a ROM, and the like. The bookbinding control unit 68 controls the operation of each part of the bookbinding device 3. Details of bookbinding control unit 68 will be described below.

(Configuration of Collective Control Device 80)

Next, the configuration of a collective control device 80 will be specifically described. FIG. 2 is a block diagram illustrating the function of the printing system 1.

As illustrated in FIG. 2, the collective control device 80 includes a job reception unit 81, a post-process determination unit 82, a sheet setting determination unit 83, a storage unit 84, and an execution management unit 85. In addition, the collective control device 80 includes, although not illustrated, a display panel (notification unit) for displaying various messages to the user.

The job reception unit 81 transmits and receives information to and from a terminal device 100. Specifically, the job reception unit 81 receives a job from the terminal device 100 being used by the user. Note that the communication mentioned here may include intranet (intra-company network) or a home network, for example, and may be either wired communication or wireless communication.

The post-process determination unit 82 determines whether or not a received job includes a bookbinding process (post-process) requiring warm-up.

When it is determined by the post-process determination unit 82 that a received top job includes a bookbinding process (post-process) and that a received subsequent job includes a bookbinding process (post-process), the sheet setting determination unit 83 determines whether or not there is a match between the sheet size (sheet setting) of the top job and the sheet size (sheet setting) of the subsequent job.

The storage unit 84, including a hard disk, a memory, or the like, stores various information to be used in the processing by the collective control device 80.

When it is determined by the sheet setting determination unit 83 that there is a match between the sheet size (sheet setting) of the top job and the sheet size (sheet setting) of the subsequent job, the execution management unit 85 causes the printing machine 2 to perform a printing process on the basis of the subsequent job, during the warm-up of the bookbinding device 3.

A communication unit 87 transmits and receives various information to and from the printing machine 2 and the bookbinding device 3, respectively.

<Operation of Printing System 1>

Next, the operation of the printing system 1 according to the first embodiment of the present invention will be described.

Figure 3:
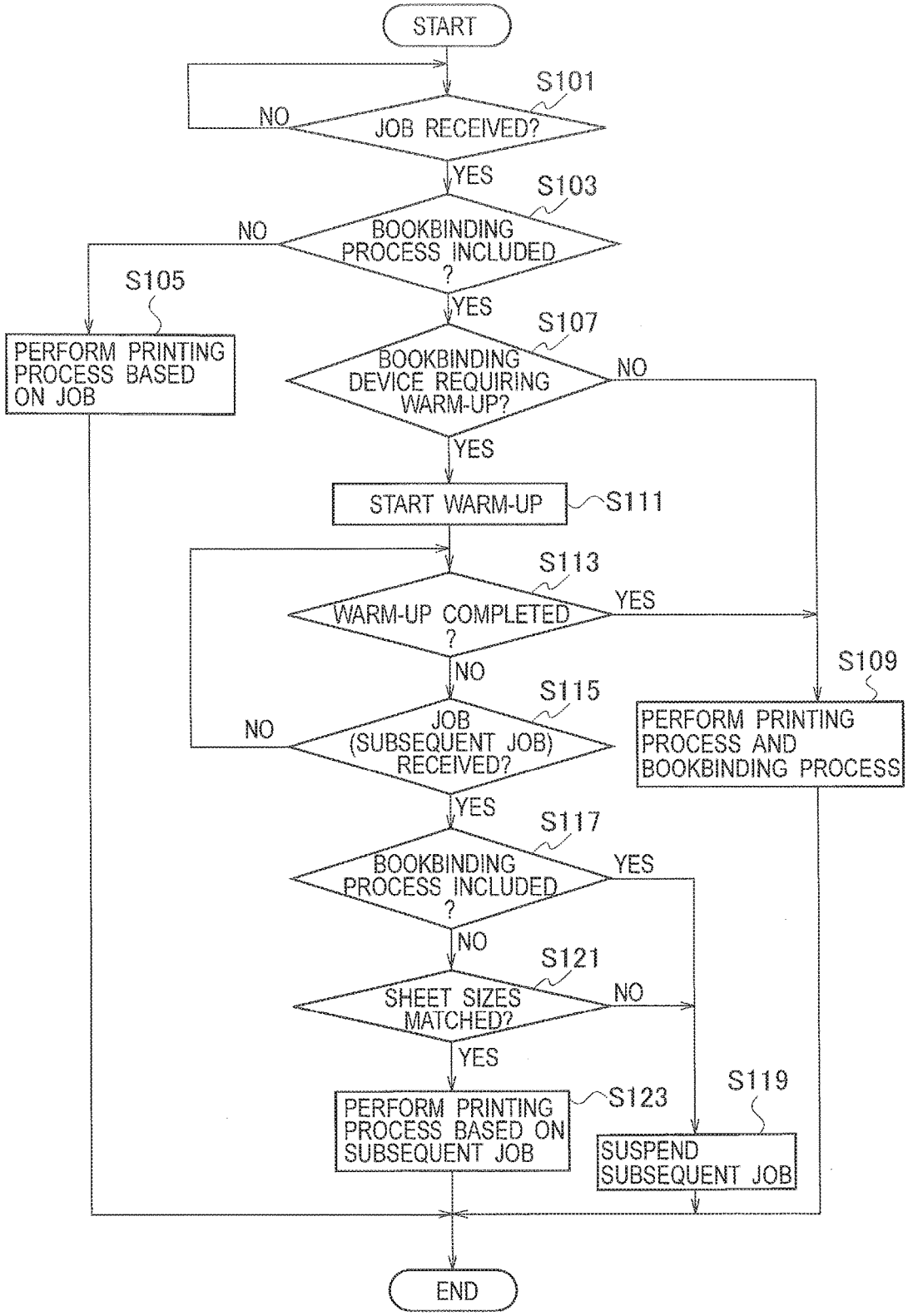
FIG. 3 is a flowchart illustrating a processing procedure in the printing system according to the first embodiment of the present invention.

FIG. 3 is a flowchart illustrating a processing procedure in the printing system 1 according to the first embodiment of the present invention.

When, as illustrated in FIG. 3, the job reception unit 81 of the collective control device 80 of the printing system 1 according to Example 1 of the present invention has received a job from the terminal device 100 (YES at step S101), the post-process determination unit 82 determines whether or not a bookbinding process is included, referring to the setting information included in the header of the received job (step S103).

When, at step S103, it is determined that a bookbinding process is not included (NO), the job is transmitted from the communication unit 87 to the print control unit 20 of the printing machine 2, and the print control unit 20 controls respective devices to perform a printing process on the basis of the received job (step S105).

When it is determined that a bookbinding process is included (YES at step S103), it is determined whether or not the bookbinding process requires warm-up (step S107). When, for example, the measured temperature of the hot melt adhesive G stored in the adhesive accommodating unit 41 is out of a suitable temperature range for an appropriate application according to the thermometer 53, it is determined that warm-up is required.

When it is determined that warm-up is not required (NO at step S107), the job is transmitted from the communication unit 87 to the print control unit 20 of the printing machine 2 and the bookbinding control unit 68 of the bookbinding device 3, and the print control unit 20 and the bookbinding control unit 68 respectively control the devices to perform a printing process and a bookbinding process on the basis of the received job, without performing warm-up (step S109).

When it is determined that warm-up is required (YES at step S107), the post-process determination unit 82 of the collective control device 80 starts warm-up (step S111). Specifically, the bookbinding control unit 68 which has been instructed to start warm-up by the post-process determination unit 82 via the communication unit 87 controls the heater 52 of the adhesive application unit 40 to raise the temperature of the hot melt adhesive G stored in the adhesive accommodating unit 41 up to an appropriate temperature range.

Subsequently, the job reception unit 81 iteratively determines whether or not a job (subsequent job) has been received (step S115) until warm-up is completed (YES at step S113), i.e., until the temperature of the hot melt adhesive G stored in the adhesive accommodating unit 41 measured by the thermometer 53 enters the suitable temperature range.

Upon completion of warm-up (YES at step S113), the process flow proceeds to step S109.

When, on the other hand, the job reception unit 81 receives a job (subsequent job) (YES at step S115) before completion of warm-up (NO at step S113), the post-process determination unit 82 determines whether or not a bookbinding process is included, referring to the setting information included in the header of the received job (subsequent job) (step S117).

When it is determined that a bookbinding process is included in the job (subsequent job) (YES at step S117), the execution management unit 85 stores the subsequent job in the storage unit 84 in order to perform the subsequent job after completion of the printing process and the bookbinding process of the top job (step S119).

When it is determined that a bookbinding process is not included in the job (subsequent job) (NO at step S117), the sheet setting determination unit 83 determines whether or not there is a match between the sheet size of the top job received at step S101 and the sheet size of the subsequent job received at step S115 (step S121).

When there is no match between the sheet size of the top job received at step S101 and the sheet size of the subsequent job received at step S115 (NO at step S121), if a printing process is performed on the basis of the subsequent job before the printing process of the top job is performed, the user may replace the sheets placed on the main paper feed unit 8 or the optional paper feed unit 12 in order to perform the printing process on the basis of the subsequent job. In such a case, attempting to perform the printing process on the basis of the top job after having performed the printing process on the basis of the subsequent job and also after completion of warm-up may result in a shortage of sheets, which makes it impossible to perform the printing process.

Accordingly, the execution management unit 85 stores the subsequent job in the storage unit 84 in order to perform the subsequent job after completion of the printing process and the bookbinding process of the top job (step S119).

When there is a match between the sheet size of the top job received at step S101 and the sheet size of the subsequent job received at step S115 (YES at step S121), even if a printing process is performed on the basis of a subsequent job before the printing process of the top job is performed, the sheets placed on the main paper feed unit 8 or the optional paper feed unit 12 are not replaced by the user.

Therefore, the subsequent job is transmitted from the communication unit 87 to the print control unit 20 of the printing machine 2 while warm-up of the bookbinding device 3 is performed in order to perform the top job, and the print control unit 20 controls the devices to perform a printing process on the basis of a received subsequent job (step S123). Accordingly, the printing process can be performed during warm-up.

Figure 4:
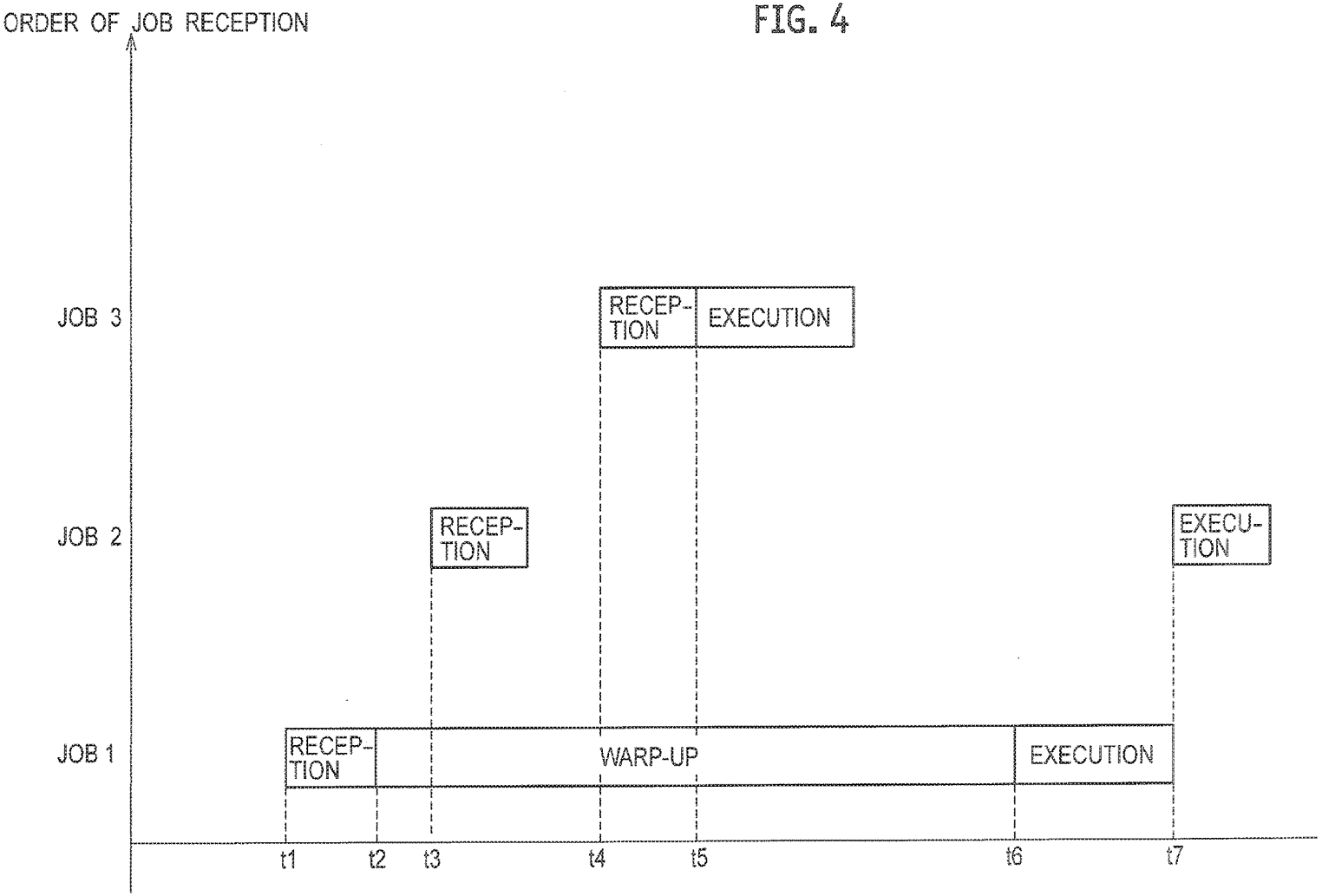
FIG. 4 is a time chart illustrating a process in the printing system according to the first embodiment of the present invention.

FIG. 4 is a time chart illustrating a process in the printing system 1 according to the first embodiment of the present invention. Here, it is assumed that the book cover sheet P1 is placed on the main paper feed unit 8 and the book body sheet P2 of the sizes A4 and B5 are placed on the optional paper feed unit 12. A job 1, which includes a bookbinding process requiring warm-up, is a job which uses the book cover sheet P1 and the book body sheet P2 of the size A4. A job 2, which does not include the bookbinding process requiring warm-up, is a job which uses the book body sheet P2 of the size A3. A job 3, which does not include a bookbinding process requiring warm-up, is a job which uses the book body sheet P2 of the size A4.

As illustrated in FIG. 4, the collective control device 80 receives the job 1 at a time point t1. The job 1 includes a bookbinding process requiring warm-up and therefore starts warm-up of the bookbinding device 3 at a time point t2.

After start of warm-up, the job 2 is received at a time point t3. The job 2 is a job which does not include a bookbinding process requiring warm-up but uses the book body sheet P2 of the size A3. Therefore, when it is assumed to perform the job 2 during warm-up, there is a possibility that the user may replace the sheets placed on the main paper feed unit 8 or the optional paper feed unit 12 with sheets of the size A3.On this occasion, attempting to perform a printing process on the basis of the job 1 after having performed a printing process on the basis of the job 2 and also after completion of warm-up may result in a failure of the printing process because the required sheets have been replaced. Therefore, the printing system 1 according to the first embodiment of the present invention temporarily stores the job 2 received at a time point t3 in the storage unit 84 without performing the job 2 immediately after the reception.

Next, the job 3 is received at a time point t4 after start of warm-up. The job 3 is a job which does not include a bookbinding process requiring warm-up and uses the book body sheet P2 of the size A4. In other words, there is a match between the sheet size of subsequent job 3 and the sheet size of the job 1 and therefore the user need not replace the sheets placed on the main paper feed unit 8 or the optional paper feed unit 12 even when the job 3 is performed during warm-up.

Therefore, in the printing system 1 according to the first embodiment of the present invention, the printing process is performed at a time point t5 on the basis of the job 3.

Next, upon completion of warm-up at a time point t6, the printing process and the bookbinding process are performed on the basis of the received job 1.

Subsequently, the printing process is performed on the basis of the job 2 temporarily stored in the storage unit 84 at a time point t7 after the printing process and the bookbinding process have been performed on the basis of the job 1.

As thus described, in the printing system 1 according to the first embodiment of the present invention, when it is determined by the post-process determination unit 82 that the received top job requires a bookbinding process (post-process) and that the received subsequent job does not require a bookbinding process (post-process), the sheet setting determination unit 83 determines whether or not there is a match between the sheet size (sheet setting) of the top job and the sheet size (sheet setting) of the subsequent job. When, subsequently, it is determined by the sheet setting determination unit 83 that there is a match between the sheet size (sheet setting) of the top job and the sheet size (sheet setting) of the subsequent job, the execution management unit 85 causes the printing machine 2 to perform the printing process on the basis of the subsequent job during the warm-up of the bookbinding device 3.

Therefore, it is possible to select a job to be performed during the warm-up of the bookbinding device 3(post-processing device) in an executable manner on the basis of the top job which includes a post-process to be performed after completion of the warm-up of the bookbinding device 3 (post-processing device).

Note that, although the printing machine 2 of the printing system 1 according to the first embodiment of the present invention includes the main paper feed unit 8 and the optional paper feed unit 12, the optional paper feed unit 12 is an optional accessory. Therefore, the optional paper feed unit 12 may be removed from the printing machine 2 and processing may be performed only with the main paper feed unit 8.

When, in such a device configuration, there is no match between the sheet size of the top job which includes a post-process requiring the warm-up and the sheet size of the subsequent job which does not include a post-process requiring the warm-up, if the subsequent job is performed in preference to the top job, the user may definitely replace the sheets placed on the main paper feed unit 8 in order to adjust to the sheet size of the subsequent job.

However, the printing system 1 according to the first embodiment of the present invention causes the printing machine 2 to perform the printing process on the basis of the subsequent job during the warm-up of the bookbinding device 3 only when it is determined that there is a match between the sheet size of the top job and the sheet size of the subsequent job. Therefore, it is possible to prevent the user from replacing the sheets placed on the main paper feed unit 8 in a state where the optional paper feed unit 12 is removed from the printing machine 2 and the printing machine 2 includes only the main paper feed unit 8.

Additionally, also in a case where the main paper feed unit 8 and the optional paper feed unit 12 are provided, when there is no match between the sheet size of the top job which includes a post-process requiring the warm-up and the sheet size of the subsequent job which does not include a post-process requiring the warm-up, similarly to the case where sheets of one and the same size are placed, if the subsequent job is performed in preference to the top job, the user may definitely replace the sheets placed on the main paper feed unit 8 or the optional paper feed unit 12 in order to adjust to the sheet size of the subsequent job.

Also in such a case, therefore, the printing system 1 according to the first embodiment of the present invention causes the printing machine 2 to perform the printing process on the basis of the subsequent job during the warm-up of the bookbinding device 3 only when it is determined that there is a match between the sheet size of the top job and the sheet size of the subsequent job, whereby it is possible to prevent the user from replacing the sheets placed on the main paper feed unit 8 or the optional paper feed unit 12.

In other words, it is possible to prevent the user from replacing the sheets placed on the paper feed tray with sheets of a different sheet setting from the sheet setting of the top job while processing a job effectively utilizing the time during warm-up, whereby a printing process and a post-process can be reliably performed on the basis of a job which includes a post-process after completion of the warm-up of the post-processing device.

Additionally, in a case where the size of sheets placed on the main paper feed unit 8 and the optional paper feed unit 12 is one type, the printing system 1 according to the first embodiment of the present invention may reliably prevent a user of a subsequent job from replacing the sheets placed on the paper feed tray with those of the sheet setting of the subsequent job in a situation where the sheet setting of the top job and the sheet setting of a subsequent job are different.

Although the printing system 1 according to the first embodiment of the present invention causes the printing machine 2 to perform the printing process on the basis of the subsequent job during the warm-up of the bookbinding device 3 when it is determined that there is a match between the sheet size of the top job and the sheet size of the subsequent job, the sheet setting is not limited to the sheet size, and the thickness or the quality of sheets, or a combination thereof, may be used to determine whether or not there is a match between the sheet setting of the top job and the sheet setting of the subsequent job.

In addition, although description has been given in the first embodiment of the present invention, taking the printing system 1 including the printing machine 2 and the bookbinding device 3 as an example, the post-processing device is not limited to the bookbinding device 3 and may be an enclosing-and-sealing device that folds, and encloses and seals a printed sheet in an envelope as a content. In other words, any post-processing device requiring warm-up may be used.

Second Embodiment

Although, in the first embodiment of the present invention, the printing process is performed on the basis of the received subsequent job while the bookbinding device 3 is being warmed up in order to perform the top job, when there is a match between the sheet size of the top job and the sheet size of the subsequent job, the present invention is not limited thereto.

Description will be given in a second embodiment of the present invention taking, as an example, the printing system 1 that notifies a sheet error according to the residual quantity of sheets when there is a match between the sheet size of the top job and the sheet size of the subsequent job. Note that, since the configuration of the printing system 1 according to the second embodiment of the present invention is the same as the configuration of the printing system 1 illustrated in FIGS. 1 and 2, explanation thereof will be omitted.

Figure 5:
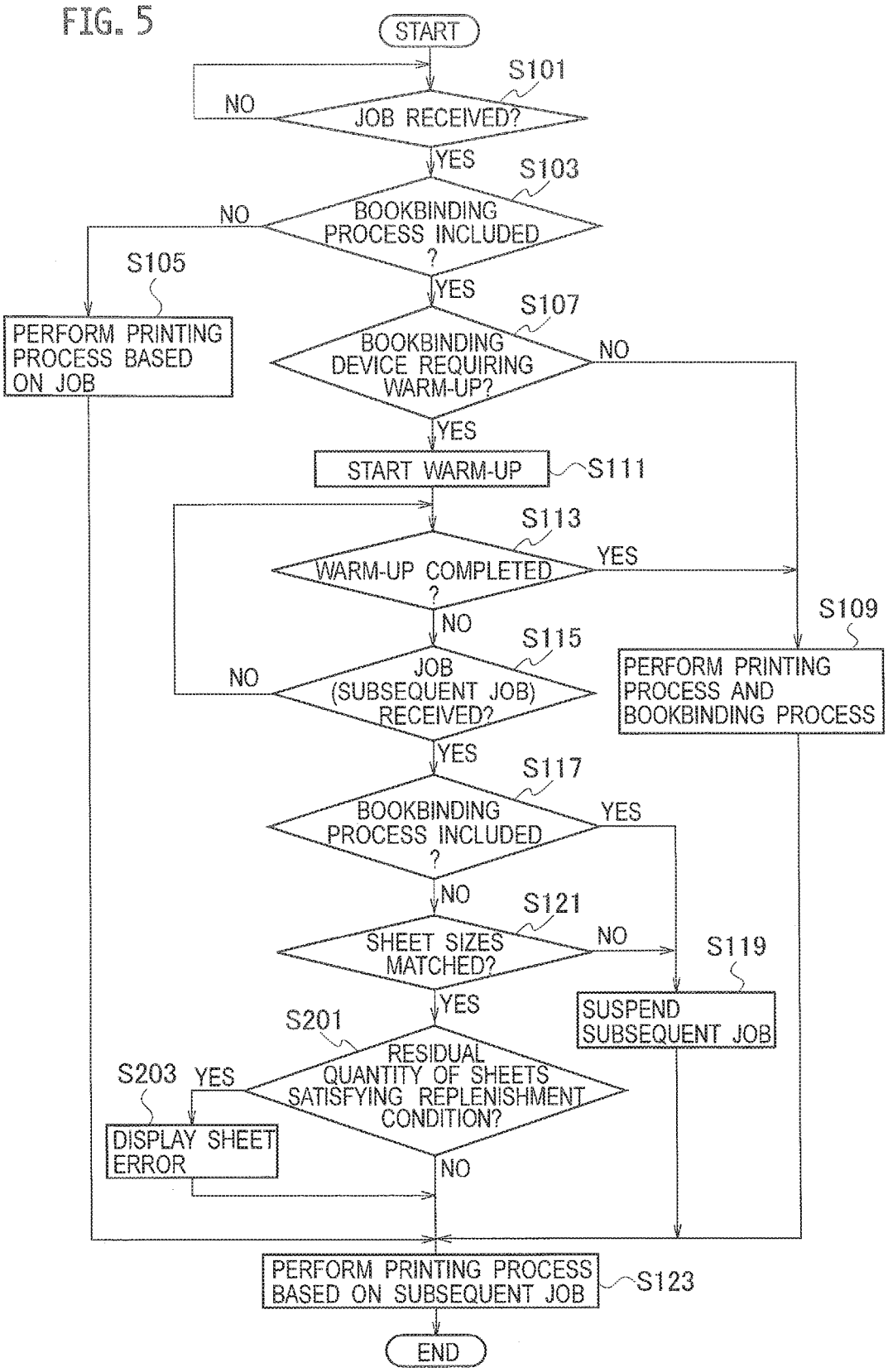
FIG. 5 is a flowchart illustrating a processing procedure in a printing system according to a second embodiment of the present invention.

FIG. 5 is a flowchart illustrating a processing procedure in a printing system 1 according to the second embodiment of the present invention. Note that, since the processes of steps S101 to S123 are the same as the processes of steps S101 to S123 illustrated in FIG. 3, explanation thereof will be omitted.

When, as illustrated in FIG. 5, there is a match between the sheet size of the top job received at step S101 and the sheet size of the subsequent job received at step S115 (YES at step S121), the execution management unit 85 determines whether or not the residual quantity of sheets satisfies a replenishment condition (step S201). Specifically, the execution management unit 85 calculates the residual quantity of sheets with the sheet sizes of the top and subsequent jobs, on the basis of a detection value of a sheet residual quantity sensor (sheet sensor) provided on the main paper feed unit 8 and the optional paper feed unit 12. It is thus determined that the residual quantity of sheets satisfies the replenishment condition when the number of sheets to be used in the top and subsequent jobs has exceeded the calculated residual quantity of sheets (YES at step S201).

Subsequently, when it is determined that the residual quantity of sheets satisfies the replenishment condition (YES at step S201), suggesting the likelihood of running out of sheets in the middle of a printing process, the execution management unit 85 displays, for example, a message "please replenish sheets" on a display panel (not illustrated). Accordingly, the user can replenish sheets on the main paper feed unit 8 and the optional paper feed unit 12 during a printing process of the top job or the subsequent job, which enables to prevent running out of sheets.

In other words, when it is desired to perform the printing process of the top job after completion of the warm-up in a case of having performed the printing process of the subsequent job while effectively utilizing the warm-up time, it is possible to avoid termination of the printing process due to a shortage of sheets required.

In addition, although the execution management unit 85 here performs the printing process on the basis of the subsequent job after having displayed a message on a display panel (not illustrated) (step S123), the invention is not limited thereto and it is also conceivable to monitor whether or not the number of sheets to be used in the top and subsequent jobs has exceeded the calculated residual quantity of sheets after having displayed the message on the display panel, and perform the printing process on the basis of the subsequent job when the number of sheets to be used in the top and subsequent jobs becomes equal to or smaller than the calculated residual quantity of sheets. Accordingly, the printing process can be started on the basis of the subsequent job after the user has reliably replenished sheets.

In addition, although, in the second embodiment of the present invention, the execution management unit 85 performs the printing process on the basis of the subsequent job after having displayed the message "please replenish sheets" on the display panel (not illustrated), for example, when it is determined that the residual quantity of sheets satisfies the replenishment condition, the present invention is not limited to thereto. The execution management unit 85 may perform the printing process on the basis of the subsequent job prior to displaying the message on the display panel.

Specifically, when there is a match between the sheet size of the top job received at step S101 and the sheet size of the subsequent job received at step S115 (YES at step S121), the execution management unit 85 firstly performs the printing process on the basis of the subsequent job (step S123). Subsequently, when it is determined that the residual quantity of sheets satisfies the replenishment condition after completion of the printing process on the basis of the subsequent job (YES at step S201), a message "please replenish sheets" may be displayed on the display panel (not illustrated), for example.

Note that the present invention is not limited strictly to the aforementioned embodiments and may be embodied by transforming the components in a range that does not deviate from the subject matter thereof at the implementation stage. In addition, various types of the invention may be formed by appropriately combining a plurality of components disclosed in the aforementioned embodiments. For example, some of the components may be eliminated from all the components described in the embodiments.

In addition, for example, each of the aforementioned functions and processes may be implemented by one or more processing circuits. The processing circuits include programmed processors, electric circuits, or the like, and further include devices such as application specific integrated circuits (ASICs), or circuit elements arranged so as to perform the described functions.

The application claims priority on the basis of Japanese Patent Application No. 2015-231207 (filed on Nov. 27, 2015), the entire content of which is incorporated herein by reference.

REFERENCE SIGNS LIST

1 printing system
2 printing machine
3 bookbinding device (post-processing device)
5 printing unit
6C, 6K, 6M, 6Y ink-jet head
7 printed sheet transfer path
8 main paper feed unit
9 paper feed tray
12 optional paper feed unit
13 paper feed tray
16 switchback unit
18 discharge unit
20 print control unit
33 alignment unit
37 cutting unit
39 clamp unit
40 adhesive application unit
41 adhesive accommodating unit
42 application roller
43 shaping unit
47 transfer unit
50 discharge unit
52 heater
53 thermometer
68 bookbinding control unit
80 collective control device
81 job reception unit
82 post-process determination unit
83 sheet setting determination unit
84 storage unit
85 execution management unit
87 communication unit

What is claimed is:

1. A printing system including a printing machine that picks up sheets placed on a paper feed tray and performs a printing process thereon, and a post-processing device that performs a post-process on the sheets printed by the printing machine, the system comprising:

a post-process determination unit configured to determine whether or not a post-process requiring warm-up is included in a received job;

a sheet setting determination unit configured to determine, when the post-process determination unit has determined that a received top job includes a post-process requiring the warm-up and that a received subsequent job does not include a post-process requiring the warm-up, whether or not there is a match between a sheet setting of the top job and a sheet setting of the subsequent job; and an execution management unit configured to cause the printing machine to perform a printing process on a basis of the subsequent job during the warm-up of the post-processing device, when the sheet setting determination unit has determined that there is a match between the sheet setting of the top job and the sheet setting of the subsequent job.

2. The printing system according to claim 1, wherein the sheets placed on the paper-feed tray are one type of sheets.

3. The printing system according to claim 2, further comprising:

a notification unit; and a residual quantity detection unit configured to detect a residual quantity of sheets placed on the paper feed tray, wherein the execution management unit causes the notification unit to give an alarm requesting replenishment of sheets before starting the subsequent job, in a case where the number of sheets in the printing machine detected by the residual quantity detection unit is smaller than the number of sheets to be used by the top job and the subsequent job, when causing the printing machine to perform a printing process on the basis of the subsequent job during the warm-up of the post-processing device.

4. The printing system according to claim 1, further comprising:

a notification unit; and a residual quantity detection unit configured to detect a residual quantity of sheets placed on the paper feed tray, wherein the execution management unit causes the notification unit to give an alarm requesting replenishment of sheets before starting the subsequent job, in a case where the number of sheets in the printing machine detected by the residual quantity detection unit is smaller than the number of sheets to be used by the top job and the subsequent job, when causing the printing machine to perform a printing process on the basis of the subsequent job during the warm-up of the post-processing device.

* * * * *